US008556500B2

(12) United States Patent
Hiranuma

(10) Patent No.: US 8,556,500 B2
(45) Date of Patent: Oct. 15, 2013

(54) TIMEPIECE

(75) Inventor: Haruki Hiranuma, Chiba (JP)

(73) Assignee: Seiko Instruments Inc. (JP)

( * ) Notice: Subject to any disclaimer, the term of this patent is extended or adjusted under 35 U.S.C. 154(b) by 54 days.

(21) Appl. No.: 13/373,376

(22) Filed: Nov. 10, 2011

(65) Prior Publication Data

US 2012/0120778 A1 May 17, 2012

(30) Foreign Application Priority Data

Nov. 17, 2010 (JP) ..... 2010-257224

(51) Int. Cl.
*G04B 39/00* (2006.01)

(52) U.S. Cl.
USPC ..... 368/295

(58) Field of Classification Search
USPC ..... 368/294–296, 205, 223, 228, 232, 236, 368/239, 243, 286–292, 297, 299–300, 319, 368/309–310, 281
See application file for complete search history.

(56) References Cited

U.S. PATENT DOCUMENTS

| | | | | |
|---|---|---|---|---|
| 4,440,505 | A * | 4/1984 | Gogniat | 368/292 |
| 5,943,302 | A * | 8/1999 | Fanshaw | 368/276 |
| 2008/0112273 | A1 * | 5/2008 | Pellaton | 368/223 |
| 2009/0003142 | A1 * | 1/2009 | Hiranuma | 368/319 |
| 2009/0231961 | A1 * | 9/2009 | El Kadiri | 368/14 |

FOREIGN PATENT DOCUMENTS

| | | |
|---|---|---|
| JP | 2007171127 | 7/2007 |

* cited by examiner

*Primary Examiner* — Edwin A. Leon
(74) *Attorney, Agent, or Firm* — Adams & Wilks

(57) ABSTRACT

A wristwatch case includes a case body, an edge member, and a mounting ring. The case body has a circular fitting hole, an edge receiving surface, and an engaging surface. The edge member includes a cylindrical portion extending through the fitting hole, a cover portion, a male screw portion, and a receiving portion. The cover portion is provided on an outer periphery of the cylindrical portion that projects out of the case body and overlaps the edge receiving surface. The male screw portion is formed on the outer periphery of the cylindrical portion that is inserted into the case body. The receiving portion is formed on the cylindrical portion and receives a peripheral portion of a dial of the movement. The mounting ring is screwed onto the male screw portion and comes into contact with the engaging surface to fix the edge member to the case body.

6 Claims, 5 Drawing Sheets

TIMEPIECE

BACKGROUND OF THE INVENTION

1. Field of the Invention

The present invention relates to portable timepieces such as wrist watches or pocket watches, stand clocks, and wall clocks.

2. Description of the Related Art

A case for accommodating an inner frame which supports a movement of a timepiece includes a glass which allows viewing a dial of the movement therethrough, and an edge member which supports the glass is fixed to a body of the case using a mounting member.

In the related art, there is a known wrist watch having an edge member configured to have a cover portion on an outer periphery of one end portion of a cylindrical portion and a female screw portion on an inner periphery of the other end portion of the cylindrical portion, and a mounting member provided with a plurality of grooves for rotational operation on an inner peripheral portion of a ring base and a male screw portion so as to bent from the inner peripheral portion at a right angle for achieving the fixation (for example, see JP-A-2007-171127 (Patent Document 1)).

The edge member of this wrist watch is provided in such a manner that the cylindrical portion thereof is fitted into a fitting hole formed by a front-side end portion of the body of the case and the cover portion is overlapped with an edge receiving surface formed by a front surface of the front-side end portion. The mounting member is provided in such a manner that the male screw portion thereof is screwed into the female screw portion of the edge member. Accordingly, the edge member is fixed to the body in a state of clamping the front-side end portion of the body between the ring base being in contact with an engaging surface formed by a back surface of the front-side end portion and the cover portion being in contact with the edge receiving surface.

FIG. 4B shows part of a wrist watch according to Patent Document 1. In the drawing, reference numeral 1 denotes a case, reference numeral 2 denotes a body, reference numeral 3 denotes a front side end portion, reference numeral 3*a* denotes an edge receiving surface, reference numeral 3*b* denotes an engaging surface, reference numeral 4 denotes a fitting hole, reference numeral 5 denotes an edge member, reference numeral 5*a* denotes a cylindrical portion, reference numeral 5*b* denotes a cover portion, reference numeral 5*c* denotes a female screw portion, reference numeral 6 denotes a mounting member, reference numeral 6*a* denotes a ring base, reference numeral 6*b* denotes a groove, reference numeral 6*c* denotes a male screw portion, reference numeral 7 denotes a glass, reference numeral 8 denotes an inner frame, reference numeral 9 denotes a movement, and reference numeral 10 denotes a dial, respectively. Also, reference numeral 5*d* denotes a receiving portion which is formed on the inner peripheral side of the cylindrical portion 5*a* and receiving a peripheral portion of the dial 10.

In the wrist watch in the related art, a screwing portion between the edge member 5 and the mounting member 6 is formed on the inner peripheral side of the cylindrical portion 5*a* of the edge member 5. Accordingly, a thickness W2 extending along the radial direction of the cylindrical portion 5*a* corresponds to a sum of a dimension B of the screwing portion where the female screw portion 5*c* and the male screw portion 6*c* mesh with each other, a hooking margin C of the dial 10 with respect to the receiving portion 5*d*, and a gap D between the dial 10 and the male screw portion 6*c*. Since the thickness W2 of the cylindrical portion 5*a* cannot be narrowed any more, a width W0 of the edge member 5 defined by an inner peripheral surface (parting surface) of the cylindrical portion 5*a* viewed through the glass 7 and an outer periphery of the cover portion 5*b* is widened caused by the thickness W2.

The timepiece having the edge member 5 being large in width is not loved in terms of design in many cases. In addition, the edge member 5 having a wide width constitutes a factor of increase in weight of the wrist watch and the mounting member 6 including the ring base 6*a* and the male screw portion 6*c* constitutes a factor of increasing the weight of the watch. Therefore, the configuration of the related art in which the edge member 5 is fixed to the body 2 as described above is disadvantageous in terms of reduction of the weight of the wrist watch.

In addition, the wrist watch of the related art is provided with the ring base 6*a* of the mounting member 6 between a distal end inside the body of the cylindrical portion 5*a* and the inner frame 8. In other words, the ring base 6*a* is disposed so as to be overlapped with the cylindrical portion 5*a* in the axial direction. Therefore, when a priority is given to the thickness of the wrist watch, it is necessary to provide an undercut portion shown by reference numeral 8*d* in FIG. 4B on the inner frame 8 to store the ring base 6*a* in the undercut portion 8*d*. Accordingly, the point to be machined on the mounting member 6 is increased, and hence high cost of production is resulted.

SUMMARY OF THE INVENTION

It is an object of the present invention to provide a timepiece in which an edge member, which is fixed to a body in a state of supporting a glass, is narrow in width.

A timepiece according to the present invention is a timepiece including an inner frame and a movement supported inside the inner frame, the inner frame and the movement being accommodated in a case, wherein the case includes: a body having a front-side end portion which forms a circular fitting hole, the front-side end portion having a front surface which constitutes an edge receiving surface and a back side which constitutes an engaging surface, an edge member including a cylindrical portion penetrating through the fitting hole, a cover portion provided on an outer periphery of a portion of the cylindrical portion projecting out of the body and overlapped with the edge receiving surface, a male screw portion formed on an outer periphery of a portion of the cylindrical portion inserted into the body, and a receiving portion formed on the cylindrical portion for receiving a peripheral portion of a dial of the movement, and a mounting ring disposed on an outer periphery of the cylindrical portion by being screwed onto the male screw portion and configured to come into contact with the engaging surface and clamp the front-side end portion between the cover portion and the mounting ring, thereby fixing the edge member to the body.

In the present invention, the edge receiving surface may be provided continuously from a front-side opening end of the fitting hole so as to protrude to the periphery, or may be provided with a level difference with respect to the front-side opening end so that the front-side opening end and the edge receiving surface are positioned at different levels in the direction of thickness of the body. Alternatively, the edge receiving surface and a back surface of the cover portion coming into contact therewith are not limited to a flat surface extending along the direction orthogonal to the direction of thickness of the body, but may be an inclined surface extending along the direction obliquely intersecting the direction of thickness of the body, or may be a curved surface curving along the direction obliquely intersecting the direction of thickness of the body.

In the present invention, the thickness of the front-side end portion of the body is preferably formed to be as small as possible within a range which guarantees a predetermined mechanical strength so that the front-side end portion is not deformed in the thickness direction thereof in terms of achieving weight reduction of the body as well as weight reduction of the edge member with decrease in length of the cylindrical portion and, in addition, in terms of preventing the mounting ring from interfering with the inner frame while securing the length of a screwing portion between the cylindrical portion and the mounting ring which ensures mounting stability of the edge member to be long. However, in the present invention, when machining an undercut on the inner frame so as to prevent the interference with the mounting ring, the front-side end portion of the body can be formed to be rather thick.

In addition, an operating portion of rotating the mounting ring in the present invention may be, for example, a plurality of projections projecting toward the inner frame, or may be a plurality of grooves opening toward the inner frame. In the present invention, although the receiving portion of the edge member may be formed of an annular projection projecting integrally from an inner peripheral surface of the cylindrical portion, but is preferably formed of grooves (operating grooves) provided on an end portion of the cylindrical portion on the side of the inner frame so as to be opened toward the inner frame and inward of the cylindrical portion respectively in terms of securing a large display area for the dial.

In the present invention, the screwing portion between the edge member and the mounting ring is provided on the outer periphery of the cylindrical portion of the edge member. Accordingly, the mounting ring does not work as an element to increase the width of the cylindrical portion, so that the width of the cylindrical portion can be reduced. Therefore, there is provided a timepiece in which an edge member, which is fixed to a body in a state of supporting a glass, is narrow in width.

According to the preferred embodiment of the present invention, the thickness of the mounting ring is substantially equal to the projecting length of the portion of the edge member inserted into the body of the cylindrical portion with respect to the engaging surface, the mounting ring is formed with a female screw portion entirely over an inner periphery thereof, and the mounting ring is formed with operating grooves opening toward the inner frame at a plurality of positions thereof.

In this preferred embodiment, a thread required for reliably fixing the edge member to the front-side end portion of the body can be secured while minimizing the thickness of the mounting ring owing to the thickness of the mounting ring with respect to the edge member and formation of the female screw portion over the entire inner peripheral surface of the mounting ring. In addition, since the operating portion used for rotating the mounting ring is formed of the operating grooves, the operating portion does not become a factor of increasing the thickness of the mounting ring. Therefore, the mounting ring can be disposed so as not to interfere with the inner frame facing thereto without providing an undercut on the inner frame so as to secure a clearance from the mounting ring.

According to the preferred embodiment of the present invention, the front-side end portion is thinner than the cover portion.

In this preferred embodiment, since the entire mounting ring is arranged closer to the cover portion corresponding to the thinness of the front-side end portion of the body, the axial length of the edge member penetrating through the fitting hole of the front-side end portion and allowing the mounting ring to be screwed on the outer periphery thereof can be reduced.

According to the preferred embodiment of the present invention, a mounting ring-side end surface of the inner frame facing the mounting ring is a flat surface.

In this preferred embodiment, since the mounting ring-side end surface of the inner frame is a flat surface, a portion of the inner frame on the side of the mounting ring does not need an undercut for accommodating the mounting ring, so that structure and manufacture of the inner frame are easy.

According to the preferred embodiment of the present invention, a diameter of a body portion of the movement is equal to or smaller than an inner diameter of the cylindrical portion, the mounting ring-side end surface of the inner frame also faces a distal end of the portion of the cylindrical portion inserted into the body.

In this preferred embodiment, since the diameter of the body portion of the movement is equal to or smaller than the inner diameter of the cylindrical portion, the body portion does not interfere with the cylindrical portion and the mounting ring. Therefore, the body portion does not need the undercut for securing a clearance from the cylindrical portion and the mounting ring, so that the problem of the present invention can be solved in the timepiece including the movement having the body portion whose diameter is equal to or smaller than the inner diameter of the cylindrical portion.

According to the preferred embodiment of the present invention, the diameter of the body portion of the movement is larger than the inner diameter of the cylindrical portion and the dial, a dial mounting surface of the body portion protruding from an outer periphery of the dial is arranged at substantially the same level as the mounting ring-side end surface of the inner frame to face the distal end of the portion of the cylindrical portion inserted into the body and the mounting ring.

In this preferred embodiment, although the diameter of the body portion of the movement is larger than the inner diameter of the cylindrical portion and the dial, the body portion does not interfere with the cylindrical portion and the mounting ring. Therefore, the body portion does not need the undercut for securing a clearance from the cylindrical portion and the mounting ring, so that the problem of the present invention can be solved in the timepiece including the movement having the body portion whose diameter is larger than the inner diameter of the cylindrical portion and the dial.

According to the present invention, there is provided a timepiece in which an edge member, which is fixed to a body in a state of supporting a glass, is narrow in width.

DETAILED DESCRIPTION OF THE PREFERRED EMBODIMENTS

Referring now to FIG. 1 to FIG. 4, a first embodiment of the present invention will be described in detail below.

Figure 1:
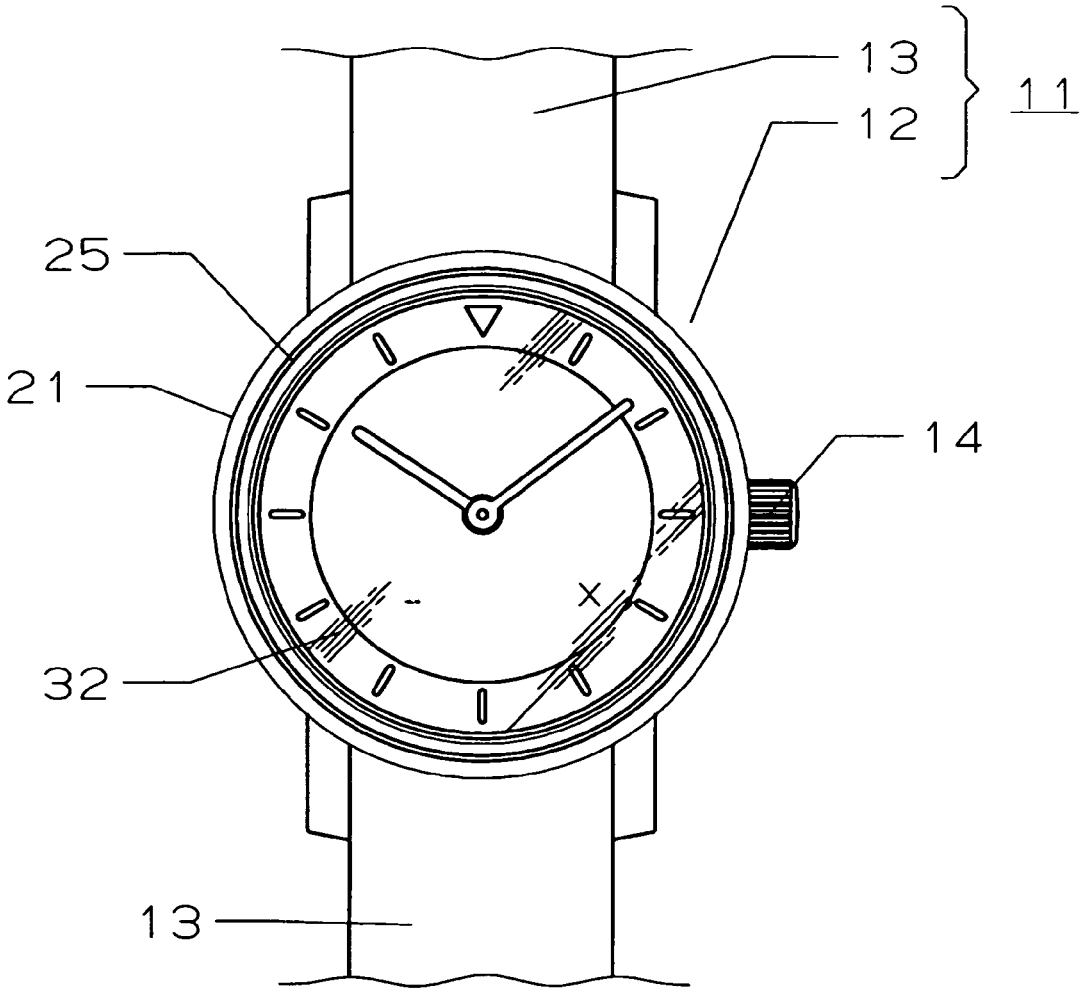
FIG. 1 is a front view showing a wrist watch according to a first embodiment of the present invention.
Figure 2:
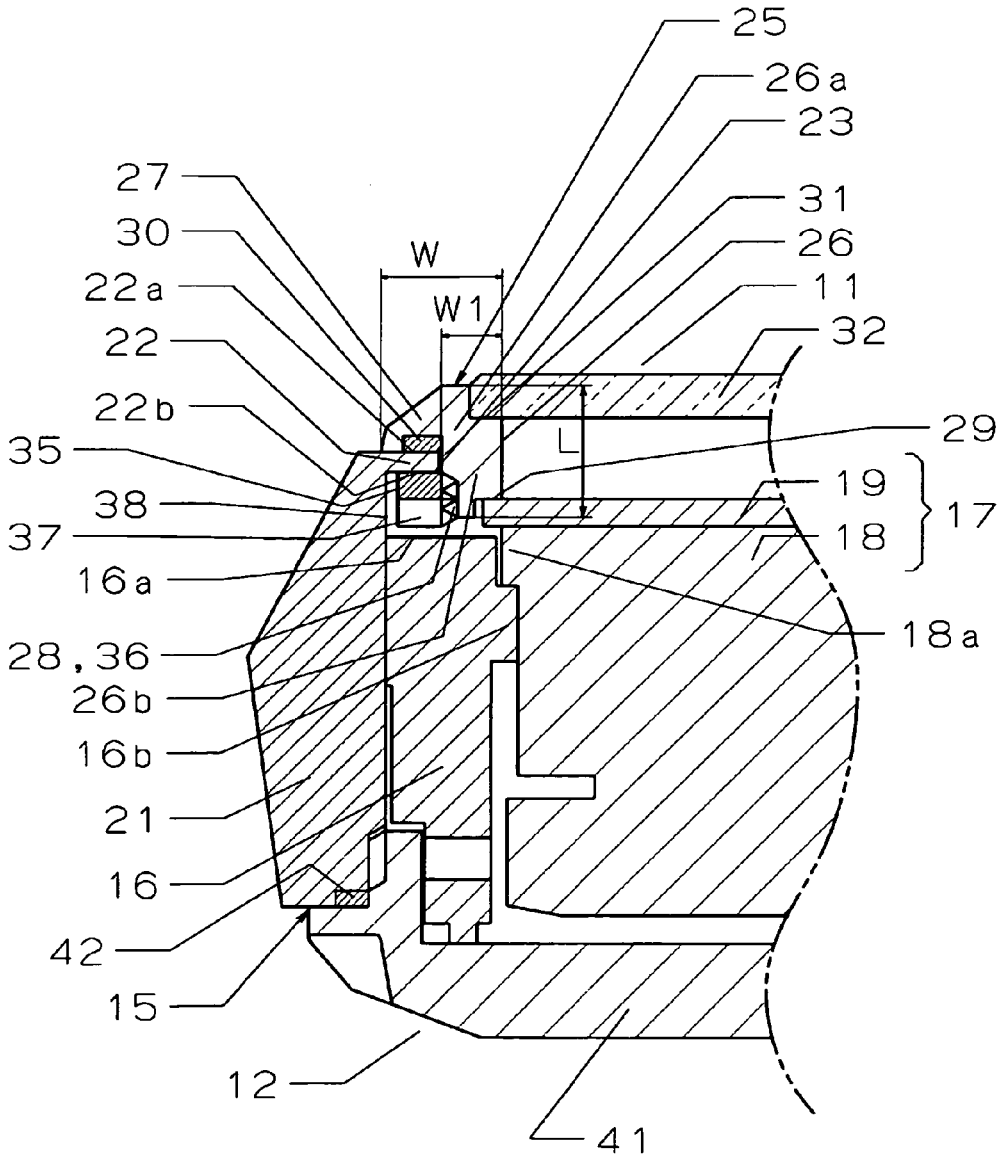
FIG. 2 is an enlarged cross-sectional view showing part of the wrist watch shown in FIG. 1.

Reference numeral 11 in FIG. 1 denotes a timepiece, for example, a portable timepiece, more specifically, a wrist watch. The wrist watch 11 is formed by attaching a member for wearing on a wrist, for example, a band 13 on a timepiece body 12. As shown in FIG. 2, the timepiece body 12 is formed by accommodating a movement 17 supported inside an inner frame 16 in a case 15 having a crown 14 (see FIG. 1) attached thereto together with the inner frame 16.

The inner frame 16 is formed of a metal into a ring shape. In FIG. 2, only a cross section of part of the inner frame 16 is shown. The inner frame 16 includes a mounting ring-side end surface 16*a* formed of a flat surface continuing in the circumferential direction in seamless manners. The mounting ring-side end surface 16*a* is an end surface to be positioned close to a mounting ring 35, described later, and facing the mounting ring 35 in the vicinity thereof, and corresponds to an upper end surface of the inner frame 16 in FIG. 2.

The inner frame 16 integrally includes a supporting portion 16*b* on an inner periphery thereof. The supporting portion 16*b* is formed of an inward projecting portion projecting from a position close to, for example, the mounting ring-side end surface 16*a* in an intermediate portion of the inner frame 16 in the height direction toward the inside of the inner frame 16, and is provided continuously in the circumferential direction of the inner frame 16 in seamless manners.

The movement 17 may be any one of those using a compact battery or a power spring as motive power, those of self-winding type, those supporting digital timepieces which display time instances or the like in digital format by a quartz oscillation module, or a combination of those supporting the digital timepieces and other types. Detailed configuration of the movement 17 has no relation with the present invention and, the movement 17 is shown as a block in FIG. 2 with hatching for the sake of easy understanding of FIG. 2.

The movement 17 is formed by attaching a dial 19 on a body portion 18. The diameter of the body portion 18 is smaller than the diameter of the dial 19. The body portion 18 includes a projecting portion 18*a* continuing to a back surface of the dial 19. The projecting portion 18*a* is provided so as to continue in the circumferential direction of the body portion 18 in seamless manners and forms the largest diameter of the body portion 18. The movement 17 is supported inside the inner frame 16 with the projecting portion 18*a* hooked on the supporting portion 16*b* of the inner frame 16 from above (from the side of a glass, described later) in FIG. 2.

The case 15 is formed by attaching a glass 32 to one end portion of a body 21 in the thickness direction via an edge member 25 and by attaching a back lid 41 to the other end portion of the body 21 in the thickness direction. The back lid 41 formed of a metal or the like is screwed into a female screw portion formed on an end portion of a back side of the body 21. Reference numeral 42 in FIG. 2 denotes an annular seal packing clamped between the body 21 and the back lid 41.

Although the body 21 is formed of a metal, it may be formed of a synthetic resin. For example, the body 21 formed of stainless steel, titanium or the like includes a front-side end portion 22. The front-side end portion 22 projects, for example, toward the inside of the body 21, and is formed with, for example, a circular fitting hole 23. The thickness of the front-side end portion 22 is preferably smaller than the thickness T of a cover portion 27, described later, shown in FIG. 4A, and is as thin as possible within a range which can ensure a strength required in particular for fixing the edge member 25, and is, for example, substantially the same as the thickness of the dial 19.

The front-side end portion 22 has a front surface which constitutes an edge receiving surface 22*a*. The edge receiving surface 22*a* is formed of a flat surface continuing to the fitting hole 23 so as to protrude from a front-side opening end of the fitting hole 23 to the periphery thereof. The front-side end portion 22 has a back surface which constitutes an engaging surface 22*b*. The engaging surface 22*b* is formed of a flat surface continuing to the fitting hole 23 so as to protrude from a back-side opening end of the fitting hole 23 to the periphery thereof, and is parallel to the edge receiving surface 22*a*.

The edge member 25 is a member used, for example, as a glass edge for holding the glass 32, and is an integral member made of a metal such as stainless steel or titanium or a synthetic resin formed into an annular shape. As shown in FIG. 2, the edge member 25 includes a cylindrical portion 26, the cover portion 27, a male screw portion 28, and a receiving portion 29. Although the cylindrical portion 26, the cover portion 27, the male screw portion 28, and the receiving portion 29 are all continued in the circumferential direction of the edge member 25 in seamless manners, only part of them is shown in FIG. 2.

The cylindrical portion 26 is a portion penetrated by the fitting hole 23, and a length L in the direction in which the center axial line (not shown) extends is longer than the thickness of the front-side end portion 22 of the body 21. An inner peripheral surface of the cylindrical portion 26 is a parting surface defining the visible area of the dial 19.

The cover portion 27 is a portion overlapped with the edge receiving surface 22*a* of the front-side end portion 22. The cover portion 27 is provided on an upper portion of the cylindrical portion 26 in FIG. 2, that is, on an outer periphery of a portion 26*a* arranged out of the body of the cylindrical portion 26 so as to protrude integrally therefrom. A distal end of the cover portion 27 and the inner peripheral surface of the cylindrical portion 26 define a width W of the edge member 25.

An annular seal packing 30 formed of resin-based resilient material is fitted to an annular holding groove formed on a back surface of the cover portion 27. The thickness of the seal packing 30 in a free state is larger than the depth of the holding groove.

The male screw portion 28 is formed on a lower portion of the cylindrical portion 26 in FIG. 2, that is, on an outer periphery of a portion 26*b* arranged by being inserted into a body of the cylindrical portion 26.

The receiving portion 29 is provided on the cylindrical portion 26. More specifically, the receiving portion 29 is provided on a distal end portion of the portion 26*b* of the cylindrical portion 26. The receiving portion 29 is formed by a distal end of the portion 26*b* and an annular groove opening inward of the cylindrical portion 26.

A peripheral portion of the glass 32 is fitted and fixed to an annular groove 31 provided on a portion on an inner peripheral side of the edge member 25. The fixation may be achieved by using an adhesive agent, or by press-fitting the glass 32 into the annular groove 31 by clamping a resilient ring between the peripheral portion of the glass 32 and the annular groove 31. The dial 19 is visible through the glass 32 closed on one end portion in the thickness direction of the body 21.

Figure 3:
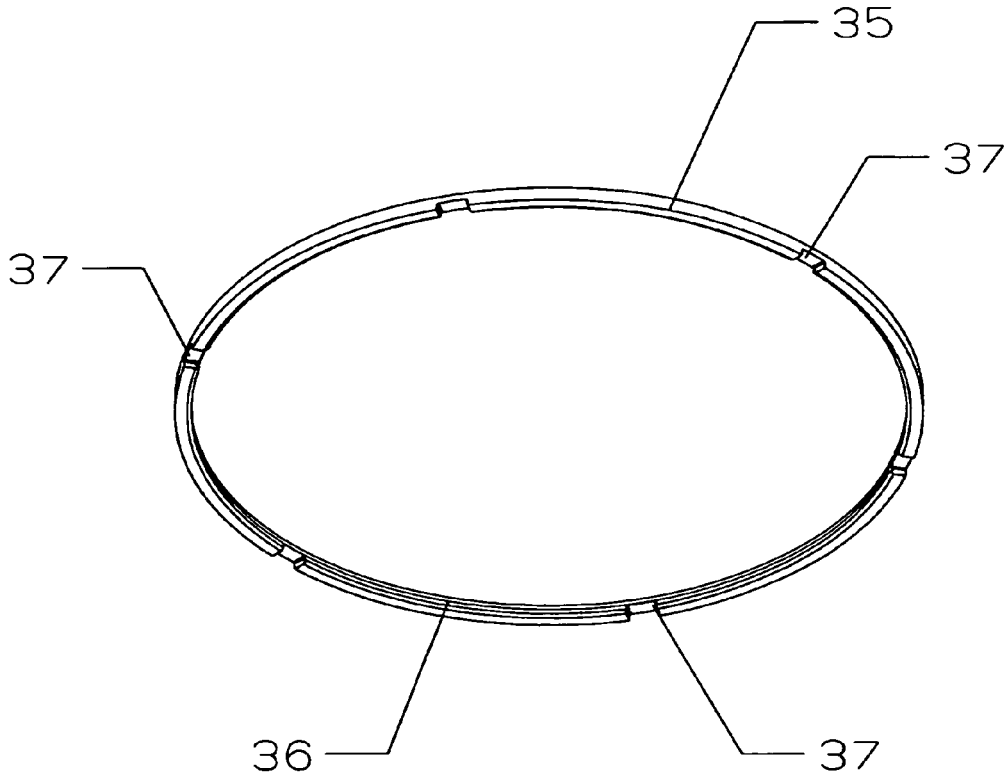
FIG. 3 is a perspective view showing a mounting ring provided in the wrist watch shown in FIG. 1.

The edge member 25 having the glass 32 mounted thereon in a manner described above is detachably fixed to the body 21 using the mounting ring 35. The mounting ring 35 is formed of a metal, is provided with a female screw portion 36 over the entire inner peripheral surface as shown in FIG. 3, and is provided with a plurality of operating portions, for example, operating grooves 37. The operating grooves 37 are provided at intervals in the circumferential direction of the mounting ring 35. The mounting ring 35 is demountably screwed into the male screw portion 28 of the edge member 25.

The fixation of the edge member 25 to the body 21 is performed according to the procedure shown below in a state in which the back lid 41 is removed.

First of all, the cylindrical portion 26 of the edge member 25 having the glass 32 and the seal packing 30 assembled thereto already is inserted through the fitting hole 23 of the body 21 from the front side of the body 21. Accordingly, the cover portion 27 of the edge member 25 is overlapped with the edge receiving surface 22*a* of the front-side end portion 22 of the body 21, and the portion 26*b* of the cylindrical portion 26 of the edge member 25 is inserted into the body 21.

Therefore, a ring accommodating groove 38 (see FIG. 2) is formed between the outer periphery of the portion 26*b*, the engaging surface 22*b* of the front-side end portion 22 and an inner peripheral surface of the body 21 on the side of the front-side end portion 22. The ring accommodating groove 38 is opened toward the inside of the body 21. Also, the male screw portion 28 formed on the outer periphery of the portion 26*b* of the cylindrical portion 26 faces the ring accommodating groove 38. In addition, the front-side end portion 22 is disposed between the cover portion 27 and the receiving portion 29 apart from each other along the axial direction of the edge member 25 so as to be in contact with the back surface of the cover portion 27.

Subsequently, the mounting ring 35 is accommodated in the body 21 from an opening of a back surface of the body 21, and the mounting ring 35 is tightened by screwing the female screw portion 36 onto the male screw portion 28 of the edge member 25. This tightening is achieved by rotating the mounting ring 35 using a tool which is hooked on at least two of the operating grooves 37.

Accordingly, the substantially entire part of the mounting ring 35 is accommodated in the ring accommodating groove 38, and the edge member 25 is pulled toward the back side of the body 21 from a moment when the mounting ring 35 comes into contact with the engaging surface 22*b* of the front-side end portion 22. This pulling is ended when the back surface of the cover portion 27 of the edge member 25 comes into contact with the edge receiving surface 22*a*. At the same time, the cover portion 27 and the mounting ring 35 clamp the front-side end portion 22 of the body 21, and the seal packing is clamped between the cover portion 27 and the edge receiving surface 22*a* in a compressed state, so that the edge member 25 is fixed to the body 21.

Also, according to the reverse order to the mounting procedure described thus far, the edge member 25 can be disassembled from the body 21. In this case, since the edge member 25 does not have to be disassembled by prying out from the front side of the body 21, there is no risk of formation of scratches on the edge member 25 and the front-side end portion 22 of the body 21. Since the edge member 25 is detachably attached with respect to the body 21 as described thus far, when the edge member 25 and the glass 32 are damaged, or when water-proof and dust-proof functions of the seal packing 30 is deteriorated, these components to be replaced can be disassembled from the body 21 for replacement. Therefore, since the body 21 does not have to be discarded together with the components to be replaced, a cost for replacement for a service client can be reduced.

As described above, the inner frame 16 in a state of supporting the movement 17 is accommodated in the body 21 through the opening on the back side and the connection between the movement 17 and the crown 14 is achieved after the edge member 25 has fixed to the body 21. Finally, the back lid 41 is attached to the body 21, and the assembly of the wrist watch 11 is completed.

In this state of completion of assembly, a peripheral portion of the dial 19 of the movement 17 is supported by being fitted into the receiving portion 29 of the edge member 25 as shown in FIG. 2. Also, the mounting ring-side end surface 16*a* of the inner frame 16 faces an end surfaces of the mounting ring 35 where the operating grooves 37 is opened (lower surface in FIG. 2) and a distal end surface of the portion 26*b* of the cylindrical portion 26 (a lower end surface of the cylindrical portion 26 in FIG. 2) in the proximity thereto, respectively.

In the wrist watch 11 in the configuration as described above, since the screwing portion between the edge member 25 and the mounting ring 35 is provided on the outer peripheral side of the portion 26*b* inserted into the body of the cylindrical portion 26 of the edge member 25, the width W of the edge member 25 fixed to the body 21 with the glass 32 supported thereby can be reduced.

In other words, since the mounting ring 35 is disposed outside the cylindrical portion 26 on the back side of the cover portion 27, a width W1 of the cylindrical portion 26 corresponds to the sum of the thickness of the male screw portion 28, the hooking margin C of the dial 19 with respect to the receiving portion 29, and the gap D between the male screw portion 28 and a peripheral surface of the dial 19. Accordingly, the mounting ring 35 does not work as an element to increase the width W1 of the cylindrical portion 26, so that the width W1 of the cylindrical portion 26 is reduced. Accordingly, the width W of the edge member 25 fixed to the body 21 with the glass 32 supported thereby can be reduced.

Figure 4A:
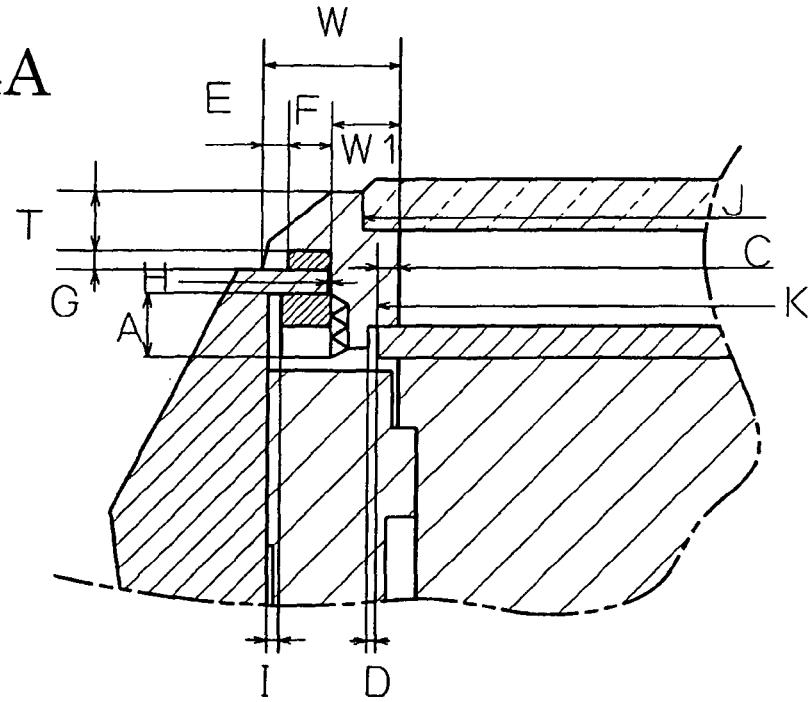
FIGS. 4A and 4B are comparative drawings for comparing dimensions of the wrist watch in FIG. 1 and a wrist watch of the related art.
Figure 4B:
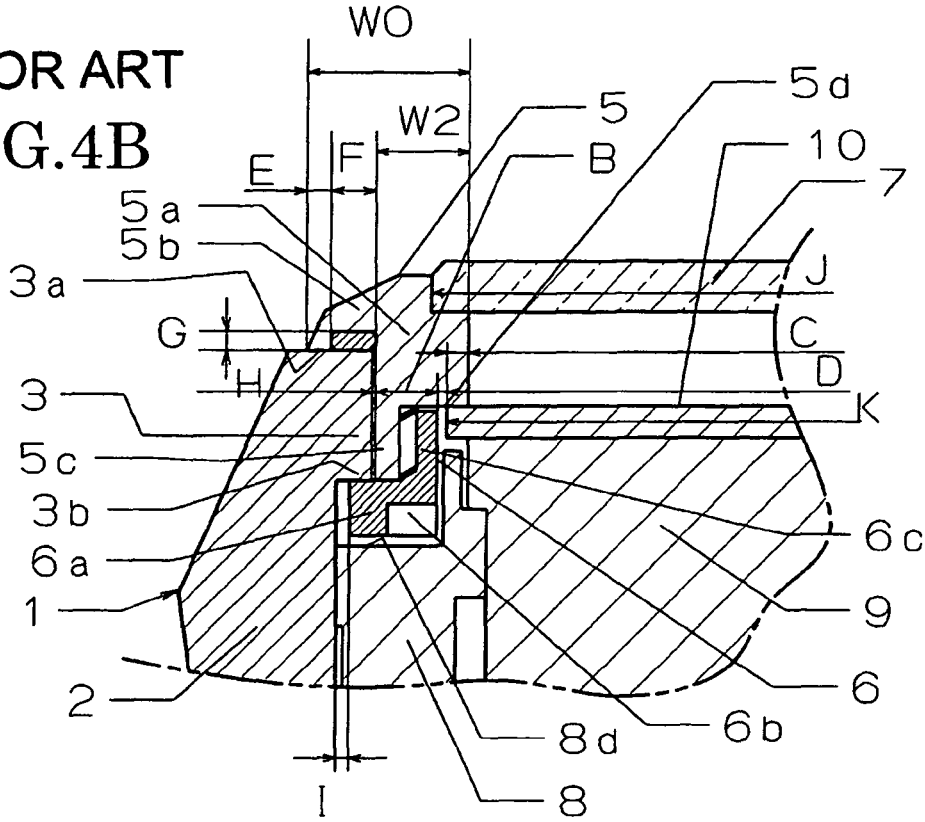
PRIOR ART FIG.4B

It is apparent from comparative drawings in FIG. 4A showing this embodiment and FIG. 4B showing the related art. Dimensions E to K of the parts in FIG. 4A and FIG. 4B are all the same and the sizes of the movements 9 and 17 and the thicknesses of the wrist watches as a whole are also the same. Reference symbol W0 in FIG. 4B denotes the width of the edge member 5, and reference symbol W2 denotes the width of the cylindrical portion 5*a* of the edge member 5. According to the comparison of these drawings, W1<W2 is satisfied and W<W0 is satisfied and, as a result of verification with actual dimensions applied thereto, 260 mm was required as the width W0 of the edge member 5 in FIG. 4B, while the width W of the edge member 25 in FIG. 4A according to this embodiment was 220 mm, so that the fact that the width of the edge member 25 can be reduced by 40 mm was verified.

In addition, in the wrist watch 11, a thickness A of the mounting ring 35 with respect to the edge member 25 is substantially equal to the projecting length of the portion 26*b* inserted into the body of the edge member 25 with respect to the engaging surface 22*b* of the front-side end portion 22, and the female screw portion 36 is formed over the entire inner peripheral surface of the mounting ring 35 as shown in FIG. 4A. Accordingly, threads as many as required for reliably fixing the edge member 25 to the front-side end portion 22 of the body 21 on the mounting ring 35 are secured while minimizing the thickness of the mounting ring 35. In addition, since the operating portion used for rotating the mounting ring 35 is formed of the operating grooves 37 opening toward the inner frame 16, the operating grooves 37 do not become a factor of increasing the thickness of the mounting ring 35.

Therefore, the mounting ring 35 can be disposed so as not to interfere with the inner frame 16 facing thereto. Also, since the mounting ring-side end surface 16*a* of the inner frame 16 is the flat surface, it is not necessary to machine an undercut for avoiding the interference with the mounting ring on the inner frame 16. Therefore, the structure and manufacture of the inner frame 16 are easy and hence cost down is achieved correspondingly.

In addition, the front-side end portion 22 of the body 21 to which the edge member 25 is fixed is thinner than the cover portion 27. Also, the mounting ring 35 is arranged on the outer periphery of the cylindrical portion 26 and has a configuration not having a portion continuing to the cylindrical portion 26 so as to overlap with the distal end on the inner side of the body. Therefore, the length L of the edge member 25 in the axial direction can be reduced. This is also apparent from the fact that the depth of insertion of the cylindrical portion 26 of the edge member 25 into the body in the configuration shown in FIG. 4A according to this embodiment is shorter than that in the configuration shown in FIG. 4B.

Since the width W of the edge member 25 as well as the length L thereof is smaller as described above, the edge member 25 achieves a compact and light-weight structure. In addition, weight reduction of the body 21 is also achieved by reducing the thickness of the front-side end portion 22 of the body 21 as described above. Furthermore, the mounting ring 35 is a screw ring having a simple configuration formed with the female screw portion 36 on the inner periphery having no portion specific for clamping the front-side end portion 22, and weight reduction is achieved.

Accordingly, the weight reduction of the wrist watch 11 is achieved, and reduction of cost of materials of the body 21, the edge member 25, and the mounting ring 35 is also achieved. Therefore, when forming at least one of the body 21 and the edge member 25 with gold, significant contribution to the weight reduction and the cost reduction of the wrist watch is achieved.

Figure 5:
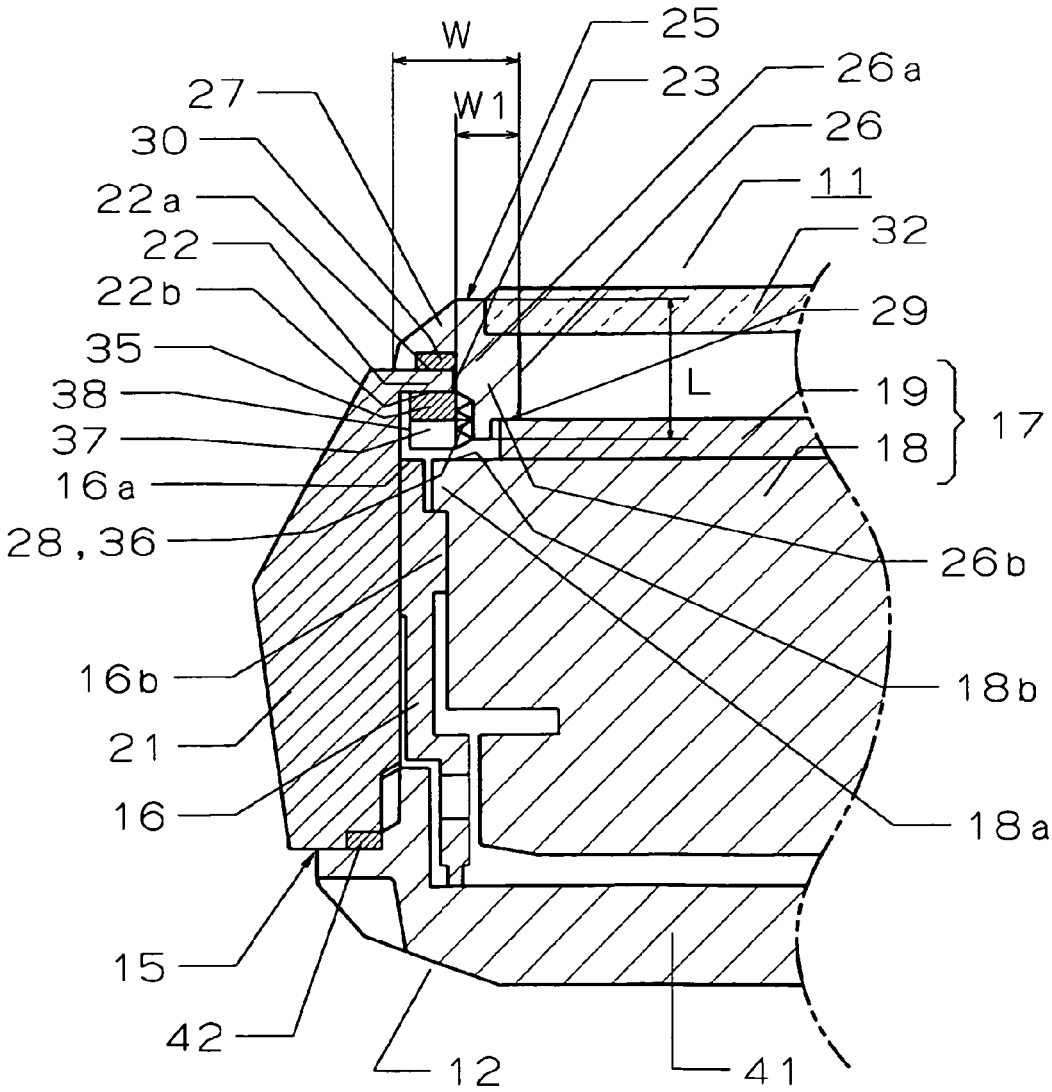
FIG. 5 is a front view showing a wrist watch according to a second embodiment of the present invention.

Referring now to FIG. 5, a second embodiment of the present invention will be described. Since the second embodiment is the same as the first embodiment other than those described below, the same configuration and the configurations having the same functions as those in the first embodiment are denoted by the same reference numerals as in the first embodiment and description will be omitted.

In the second embodiment, the thickness of the inner frame 16 is reduced and, at the same time, a diameter of the body portion 18 of the movement 17 is increased corresponding to the reduction of the thickness. The maximum diameter of the body portion 18 is larger than an inner diameter of the cylindrical portion 26 of the edge member 25 and is larger than the dial 19. Therefore, the peripheral portion of the body portion 18 protrudes from the dial 19, and an upper surface of the protruded peripheral portion constitutes part of a dial mounting surface 18*b*.

The dial mounting surface 18*b* is a flat surface in the same manner as the mounting ring-side end surface 16*a* of the inner frame 16. The dial mounting surface 18*b* is arranged at the substantially same level as the mounting ring-side end surface 16*a* of the inner frame 16. The dial mounting surface 18*b* faces the distal end surface of the portion 26*b* inserted into the body of the cylindrical portion 26 and a lower surface of the mounting ring 35 respectively in proximity thereto in FIG. 5. The mounting ring-side end surface 16*a* faces the lower surface of the mounting ring 35 in proximity thereto in FIG. 5. Portions other than items described above are the same as the first embodiment.

Therefore, in the second embodiment relating to the wrist watch 11 including the movement 17 having the body portion 18 whose diameter is larger than the inner diameter of the cylindrical portion 26 and the dial 19, the object of the present invention is achieved by the reasons described already in the first embodiment, and the width W of the edge member 25 fixed to the body 21 with the glass 32 supported thereby can be reduced.

In addition, by fixing the edge member 25 to the front-side end portion 22 of the body 21 in the configuration described above, the body portion 18 does not interfere with the cylindrical portion 26 and the mounting ring 35 irrespective of the fact that diameter of the body portion 18 of the movement 17 is larger than the inner diameter of the cylindrical portion 26 and the dial 19. Therefore, the body portion 18 does not have to have an undercut for securing a clearance from the cylindrical portion 26 and the mounting ring 35. Therefore, the wrist watch 11 in which the movement 17 having the body portion 18 whose diameter is larger than the inner diameter of the cylindrical portion 26 and the dial 19 is integrated in the case 15 is provided.

What is claimed is:

1. A timepiece comprising an inner frame and a movement supported inside the inner frame in a case, wherein the case includes:

a body having a front-side end portion which forms a circular fitting hole, the front-side end portion having a front surface which constitutes an edge receiving surface and a back side which constitutes an engaging surface, an edge member including a cylindrical portion penetrating through the fitting hole, a cover portion provided on an outer periphery of a portion of the cylindrical portion projecting out of the body and overlapped with the edge receiving surface, a male screw portion formed on an outer periphery of a portion of the cylindrical portion inserted into the body, and a receiving portion formed on the cylindrical portion for receiving a peripheral portion of a dial of the movement, and a mounting ring disposed on an outer periphery of the cylindrical portion by being screwed onto the male screw portion and configured to come into contact with the engaging surface and clamp the front-side end portion between the cover portion and the mounting ring, thereby fixing the edge member to the body.

2. The time piece according to claim 1, wherein a thickness of the mounting ring is substantially equal to a projecting length of the portion of the edge member inserted into the body of the cylindrical portion with respect to the engaging surface, the mounting ring is formed with a female screw portion entirely over an inner periphery thereof, and the mounting ring is formed with operating grooves opening toward the inner frame at a plurality of positions thereof.

3. The timepiece according to claim 2, wherein the front-side end portion is thinner than the cover portion.

4. The timepiece according to claim 3, wherein a mounting ring-side end surface of the inner frame facing the mounting ring is a flat surface.

5. The timepiece according to claim 4, wherein a diameter of a body portion of the movement is equal to or smaller than an inner diameter of the cylindrical portion, the mounting ring-side end surface of the inner frame also faces a distal end of the portion of the cylindrical portion inserted into the body.

6. The timepiece according to claim 4 wherein a diameter of the body portion of the movement is larger than the inner diameter of the cylindrical portion and the dial, a dial mounting surface of the body portion protruding from an outer periphery of the dial is arranged at a substantially same level as the mounting ring-side end surface of the inner frame to face the distal end of the portion of the cylindrical portion inserted into the body and the mounting ring.

* * * * *